United States Patent [19]

Faurote, Jr. et al.

[11] Patent Number: 4,612,141

[45] Date of Patent: Sep. 16, 1986

[54] PAINT REMOVING CLEANING COMPOSITIONS

[76] Inventors: Dolph Faurote, Jr.; Dolph Faurote, III, both of 9218 Balcmes Club Dr., Austin, Tex. 78750

[21] Appl. No.: 750,134

[22] Filed: Jul. 1, 1985

[51] Int. Cl.[4] ..... C11D 1/62; C11D 3/18; C11D 3/48

[52] U.S. Cl. ..... 252/546; 252/153; 252/171; 252/547; 252/DIG. 14

[58] Field of Search ..... 252/153, 546, 547, 171, 252/DIG. 14

[56] References Cited

U.S. PATENT DOCUMENTS

| | | | |
|---|---|---|---|
| 705,139 | 7/1902 | Priestman | 252/DIG. 8 |
| 982,524 | 1/1911 | Patty | 252/DIG. 8 |
| 1,488,881 | 4/1924 | Jackson | 252/DIG. 8 |
| 3,600,322 | 8/1971 | Morison | 252/171 |
| 3,681,251 | 8/1972 | Morison | 252/162 |
| 3,980,587 | 9/1976 | Sullivan | 252/546 |
| 4,125,476 | 11/1978 | Dean | 252/115 |
| 4,406,707 | 9/1983 | Moore et al. | 134/4 |

FOREIGN PATENT DOCUMENTS 131461 2/1949 Australia .

*Primary Examiner*—Prince E. Willis
*Attorney, Agent, or Firm*—Walter C. Farley

[57] ABSTRACT

A cleansing composition includes naptha, alkyl dimethyl benzyl ammonium chloride, alcohol, tetrasodium ethylenediaminetetraacetate, ammonia, pine oil and water. The composition is very effective for removing paints, varnishes and other materials from carpet. A composition including naptha, alkyl dimethyl benzyl ammonium chloride, tetrasodium ethylenediaminetetraacetate, ammonia, pine oil and water is particularly useful to remove paint from hard surfaces.

2 Claims, No Drawings

PAINT REMOVING CLEANING COMPOSITIONS

This invention relates to cleansing solutions which are effective to remove paint, one formulation being particularly effective to remove paints, varnishes and the like from fabric articles such as carpet and, in another formulation, to remove paints, varnishes and the like from baked-on or fired surfaces.

BACKGROUND OF THE INVENTION

Removal of paint and the like from carpet is a particularly difficult cleaning task and one which is very important to owners and operators of rental properties such as apartments as well as to home owners. The importance of the problem has increased with greater use in recent years of wall-to-wall carpeting and with increased use, in general, of carpeting in apartments. The problem is also aggravated by the increased use of spray-painting which can leave paint residue on carpets.

It is also desirable to be able to remove paint from the surfaces of appliances such as refrigerators and stoves which have baked-on enamel finishes as well as from tile surfaces, i.e., surfaces which have fired ceramic glazes or similar finishes. A common problem is the removal of paint which is the result of over-spraying or accidental contact.

BRIEF SUMMARY OF THE INVENTION

Accordingly, an object of the present invention is to provide a cleansing solution capable of removing paint, varnish or the like from carpet without damaging the carpet.

A further object is to provide a cleansing solution for removing paint, especially dried paint, from baked-on or fired surfaces.

In general, the invention includes a cleansing composition effective for removal of paints, varnishes and the like from fabric articles such as carpet comprising, by volume, about 9.4 parts naptha, about 0.17 parts alkyl dimethyl benzyl ammonium chloride, about 0.02 parts ethyl alcohol, about 0.008 parts tetrasodium ethylenediaminetetraacetate and about 3.125 parts ammonia, all of these being mixed with about 84 parts of water and 3.5 parts of pine oil. The alkyl dimethyl benzyl ammonium chloride preferably comprises 50% $C_{14}$, 40% $C_{12}$ and 10% $C_{16}$, by weight, and is believed to function as a detersive agent. These ingredients are combined at room temperature (about 25.8° C.) and atmospheric pressure, preferably under an exhaust hood.

In another aspect, the invention includes a composition for cleansing paint from hard surfaces comprising, by volume, about 9.4 parts naptha, about 0.32 parts alkyl dimethyl benzyl ammonium chloride, about 0.015 parts tetrasodium ethylenediaminetetraacetate and about 3.125 parts ammonia mixed with about 87 parts of water and 0.012 parts of pine oil. The pine oil in this composition is included primarily as a scenting agent but may also function as a penetrant.

The alkyl dimethyl benzyl ammonium chloride preferably comprises 50% $C_{14}$, 40% $C_{12}$ and 10% $C_{16}$, by weight, and is believed to function as a detersive agent. The ingredients are combined at room temperature and atmospheric pressure, preferably under an exhaust hood.

The following examples are provided for the purpose of illustrating the invention and it will be understood that the invention is not limited thereto.

EXAMPLE 1

A sufficient quantity of solution in accordance with the invention was prepared by mixing together the following ingredients in the stated proportions at room temperature under an exhaust hood and at atmospheric pressure.

9.375 parts naptha
1.6875 parts alkyl dimethyl benzyl ammonium chloride (50% $C_{14}$, 40% $C_{12}$, 10% $C_{16}$)
0.125 parts ethyl alcohol
0.00813 parts tetrasodium ethylenediaminetetraacetate
3.125 parts ammonia (8%)
3.516 parts pine oil
83.8 parts water Various rug samples from various manufacturers, were collected from standard retail and wholesale outlets, and fast-drying enamel paints containing red iron oxides and carbon black with vehicles including vinyl toluene resin, aliphatic, aromatic and halogenated hydrocarbons and propellants including propane and isobutane were applied to the carpet samples. Latex base paints and oil base paints were also applied. The carpet samples included various designs, color patterns and thicknesses.

The paints were sprayed on and poured onto the carpet samples in various patterns leaving, in each case, a substantial section of each carpet sample for comparison of color and texture.

The paints and varnishes were allowed to dry for various intervals of time ranging from 10 minutes to 24 hours before the cleaning solution was applied. In other tests paint and varnish was removed from carpet after having been allowed to remain thereon for indeterminate periods in the order of months.

The cleansing solution described above was then applied to the carpet samples in the areas soiled with paint and allowed to stand for about 1–12 seconds. The soiled areas were then rubbed with cloth.

In all cases the paint and varnish was removed completely leaving no trace and leaving no residue from the solution. No loss of color from the original dyes was observed.

The composition of Example 1 has also been employed as a general purpose spot remover with excellent results in the removal of cloth stains resulting from coffee, soft drinks, blood, grease, dirt stains and other substances.

The cleansing solution can be applied effectively in either of two ways, by spraying the solution onto the area or by dampening a section of cloth and applying the cloth to the soiled carpet. When using a cloth, the section dampened with cleansing solution should be held directly on the soiled area for 10–12 seconds. If the spraying technique is used, best results are obtained when the solution is allowed to remain on the soiled area for a similar time, 10–12 seconds. The cloth is then rubbed with a circular motion, regardless of which technique is used for applying the solution, while applying pressure to the area to remove the paint or varnish.

EXAMPLE 2

A quantity of cleaning solution in accordance with the invention was prepared by mixing together the following ingredients at room temperature and atmospheric pressure under an exhaust hood.

9.375 parts naptha 0.3164 parts alkyl dimethyl benzyl ammonium chloride (50% $C_{14}$, 40% $C_{12}$, 10% $C_{16}$)

0.01523 parts tetrasodium ethylenediaminetetraacetate 3.125 parts ammonia 0.0117 parts pine oil 87 parts water The solution was tested by brushing, rolling and spraying paint on refrigerators and ranges having baked-on enamel surfaces and on tile with a fired surface. The cleansing composition was applied in some cases by spraying onto the soiled surface with a pump-type sprayer. In other cases a small amount of cleansing solution was poured on the soil area and given 10–12 seconds to act. A nylon brush such as a small scrub brush was then used to remove the paint without damage to the finish.

The composition in accordance with Example 2 has also been employed to penetrate and remove road tar and grease from automobile surfaces by spraying the solution on and removing it without harm to the automobile finish. It is also useful in the construction field by "final clean" crews assigned the task of performing the final cleaning on newly constructed apartment dwellings before they are occupied. This cleansing solution can also be applied by cloth. The solution in accordance with Example 2 should not be used on carpet and, when cleaning materials from the exterior of a car, the car should not be allowed to be in the sun immediately before or after application of the solution.

What is claimed is:

1. An aqueous cleansing composition effective for removal of paints, varnishes and the like from fabric articles such as carpet consisting essentially of by volume about 9.4 parts naphtha, about 0.17 parts alkyl dimethyl benzyl ammonium chloride, about 0.02 parts ethyl alcohol, about 0.008 parts tetrasodium ethylenediaminetetraacetate, about 3.125 parts ammonia, 0.12 to 3.5 parts pine oil, and water to make 100 parts.

2. An aqueous composition for cleansing paint from baked enamel and fired ceramic surfaces consisting essentially of, by volume, about 9.4 parts naphtha, about 0.32 parts alkyl dimethyl benzyl ammonium chloride, about 0.015 parts tetrasodium ethylenediaminetetraacetate, about 3.125 parts ammonia, 0.12 to 3.5 parts pine oil, and water to make 100 parts.

* * * * *